US007210650B2

(12) United States Patent
Metzger

(10) Patent No.: US 7,210,650 B2
(45) Date of Patent: May 1, 2007

(54) PAPER-BACK TAPE DISPENSER

(76) Inventor: Brian David Metzger, P.O. Box 586, Ellensburg, WA (US) 98926

( * ) Notice: Subject to any disclaimer, the term of this patent is extended or adjusted under 35 U.S.C. 154(b) by 296 days.

(21) Appl. No.: 11/018,096

(22) Filed: Dec. 20, 2004

(65) Prior Publication Data

US 2005/0133654 A1 Jun. 23, 2005

Related U.S. Application Data

(60) Provisional application No. 60/531,267, filed on Dec. 22, 2003.

(51) Int. Cl.
*B65H 16/00* (2006.01)

(52) U.S. Cl. ..... 242/588.6; 242/422.5; 225/39; 225/46

(58) Field of Classification Search ..... 242/422.5, 242/588.6; 225/39, 46
See application file for complete search history.

(56) References Cited

U.S. PATENT DOCUMENTS 144,420 A * 11/1873 Stokes ..... 242/588.6
3,283,886 A * 11/1966 Addis et al. ..... 242/588.6
3,796,341 A * 3/1974 Berman ..... 242/588.6

* cited by examiner

*Primary Examiner*—John Q. Nguyen
(74) *Attorney, Agent, or Firm*—Dean A. Craine

(57) ABSTRACT

A paper back tape dispenser that includes a cylindrical outer shell with a center cavity designed to receive a standard roll of paper back tape. The outer shell includes a side opening with a forward extending lip. Formed on the distal edge of the lip is a serrated cutting edge. Aligned and attached to the rear surface of the outer shell is a hollow pipe Formed on the inside and outside surfaces of the short pipe are two longitudinally aligned slots. Located inside the short pipe is a sliding piston. Extending through the piston and the pipe is an axle that partially extends into the cavity to hold a spool that fits inside a roll of tape. A spring is disposed inside the pipe that automatically holds the axle in an upward position on the pipe. During use, the portion of the axle that extends outward acts as a finger bar that is used to lift the axle upward so that new, large roll of tape may be placed over the axle and into the cylindrical cavity.

3 Claims, 3 Drawing Sheets

PAPER-BACK TAPE DISPENSER

This Utility Patent Application is based on Provisonal Patent Application (Ser. No. 60/531,267) filed Dec. 22, 2003.

BACKGROUND OF THE INVENTION

1. Field of the Invention

This invention relates to tape dispensers, and more particularly, to tape dispensers used with adhesive tape that uses a paper layer that is removed prior to application.

2. Description of the Related Art

There are three types of paper back tapes commonly used in the HVAC industry. The first one is a vinyl tape product made by Nashua Corporation of Nashua, N.H. (Product No. NAS-8223). The second is a foil packed tape product also sold by Nashua Corporation (Product No. NAS-323). A third is a reinforced packed tape product also sold by Nashua Corporation (Product No. NAS-FSK-3). All three types of tape are approximately 3 inches in width and distributed in rolls approximately 6 inches in diameter. Typically approximately 30 yards of tape are rolled onto a center spool approximately 3 inches in the diameter.

With all three types of HVAC tape products, the paper back layer must be removed to expose the adhesive surface prior to application. Because a roll of tape is relatively large and is usually held in one hand when used, unwinding the roll to dispense the desired amount of tape, cutting the tape, the removing the paper back layer, and then evenly applying the tape over the desired joint and layer of foil or vinyl back insulation can be difficult and time consuming. Because the adhesive may fold back onto itself, excessive waste can result. These problems are compounded when the ductwork is located in restricted or confined work areas.

All three types of tape products are difficult to tear or rip with the user's hands. In order to remove a section of tape from the roll, most workers carry a knife with a serrated blade. Because the tape is relatively stiff, the roll must be tightly held or secured against a surface at all times to prevent it from unraveling. Even when great care is taken to prevent unraveling, workers often spend a considerable amount of time rewinding rolls of tape after each use.

What is needed is a tape dispenser for ductwork tape that is easy to handle, promotes easy dispensing and simultaneous removal of the paper back layer from the section of tape as it is dispensed, eliminates the use of a knife, and maintains the roll of tape in a tight, unraveled condition between uses.

SUMMARY OF THE INVENTION

The above stated objectives are met by the paper-back tape dispenser, disclosed herein, that includes a cylindrical outer shell made of sheet metal attached to a transversely aligned back plate. Formed on one side of the outer shell is an opening with a forward extending lip with a serrated cutting edge. The back plate is securely attached to the back edge of the outer shell thereby forming a cylindrical cavity inside the outer shell capable of receiving a spool of paper back tape.

Longitudinally aligned and attached to the rear surface of the back plate is a hollow short pipe. Located inside the pipe is a sliding piston that acts as a stabilizer for the axle discussed further below. Formed on opposite sidewalls of the short pipe are two longitudinally aligned slots. Perpendicularly aligned and extending transversely through the pipe, through the two slots, and through the piston is an axle. The axle is off-centered on the pipe so that the length of the section of axle that extends into the cavity is sufficient to length to extend into the center hole on a spool of tape placed into the cavity. The axle is sufficient in diameter so that a spool placed into the center hole on a roll of tape may rotate freely thereon on the axle. The opposite end of the axle extends outward through the outside surface of the pipe. Suitable nuts and washers are used to securely hold the spool on the axle. During use, the portion of the axle that extends outside the pipe is a finger bar that is used to lift the axle relative to the pipe so that the new roll of tape may be placed over the axle and into the cavity.

A spring is disposed inside the short pipe and biased between the top surface of the pipe and the top surface of the axle. During operation, the spring constantly forces the axle upward in the pipe so that the upper surface of a roll of tape is automatically pressed against the upper, inside, surface of the outer shell thereby preventing the roll from unraveling.

During use, the user selects a roll of tape and grabs the exposed end of the tape and separates the paper-back layer from the tape. The paper backing is wrapped around the roll of tape counter clockwise to expose the adhesive layer around the entire roll of tape. The finger bar is then lifted and the roll of tape is then placed onto the spool and into the cavity. finger bar is then released thereby allowing the roll of tape to be pressed against the lower inside surface of the outer shell.

The dispenser is normally held vertically with one hand while the end of the tape is extended through the side opening. The user places his or her thumb on the lip structure and then wraps the tips of the other four fingers around the outer edge of the roll and holds the roll against the upper inside surface of the outer housing. To dispense tape, the end of the tape is pulled outward and the paper layer is automatically removed. The tape is then pulled upward to cut the tape over the serrated edge.

DESCRIPTION OF THE PREFERRED EMBODIMENT(S)

Figure 1:
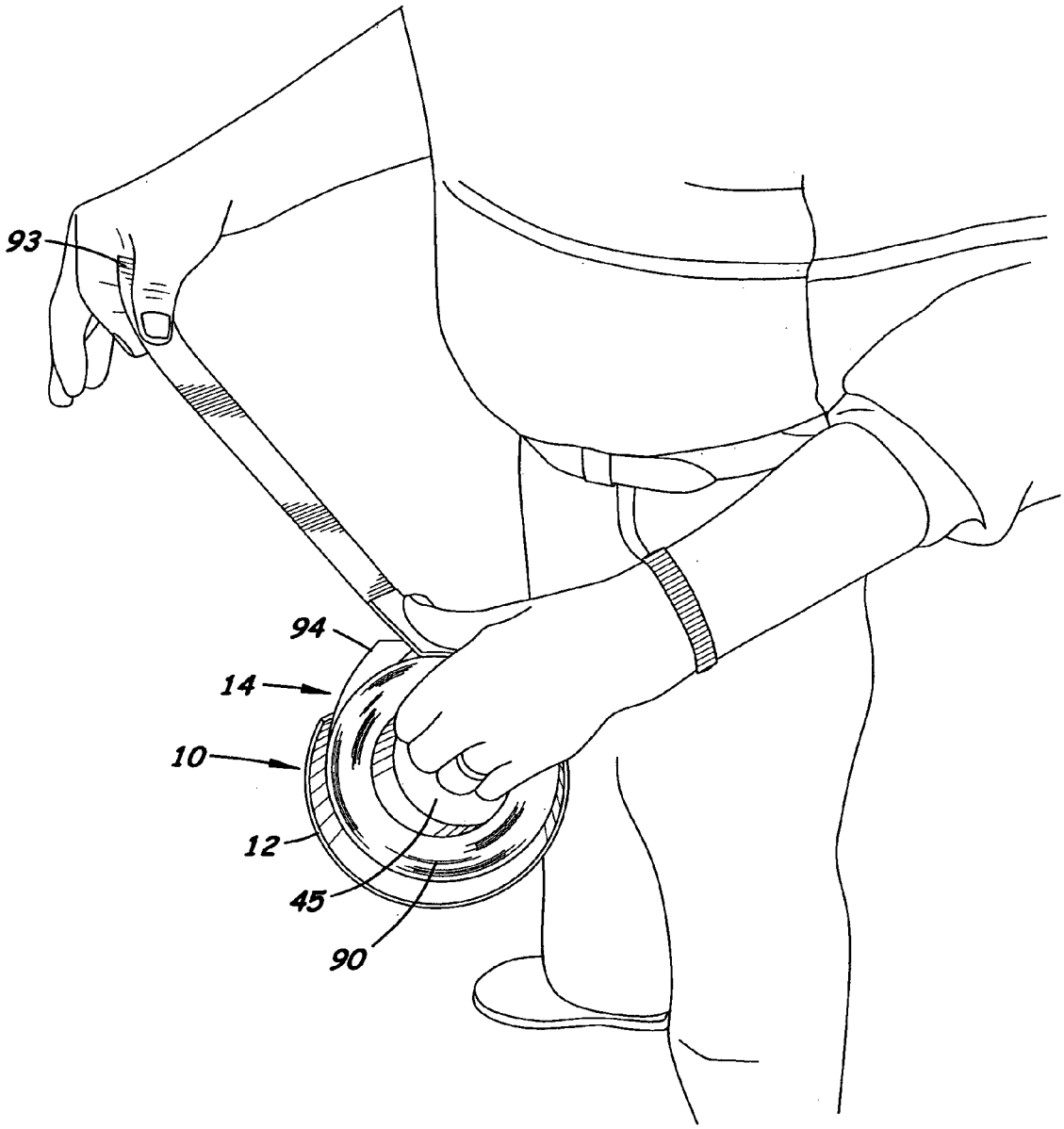
FIG. 1 is a perspective view of a user holding the tape dispenser and dispensing a section of tape.
Figure 2:
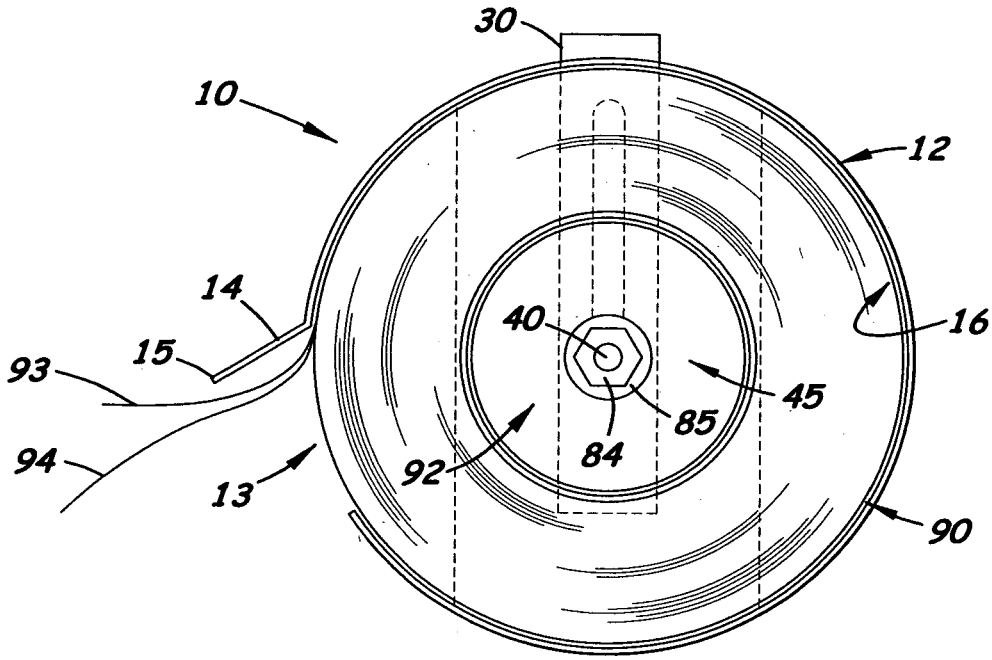
FIG. 2 is a front side elevational view of the dispenser.
Figure 3:
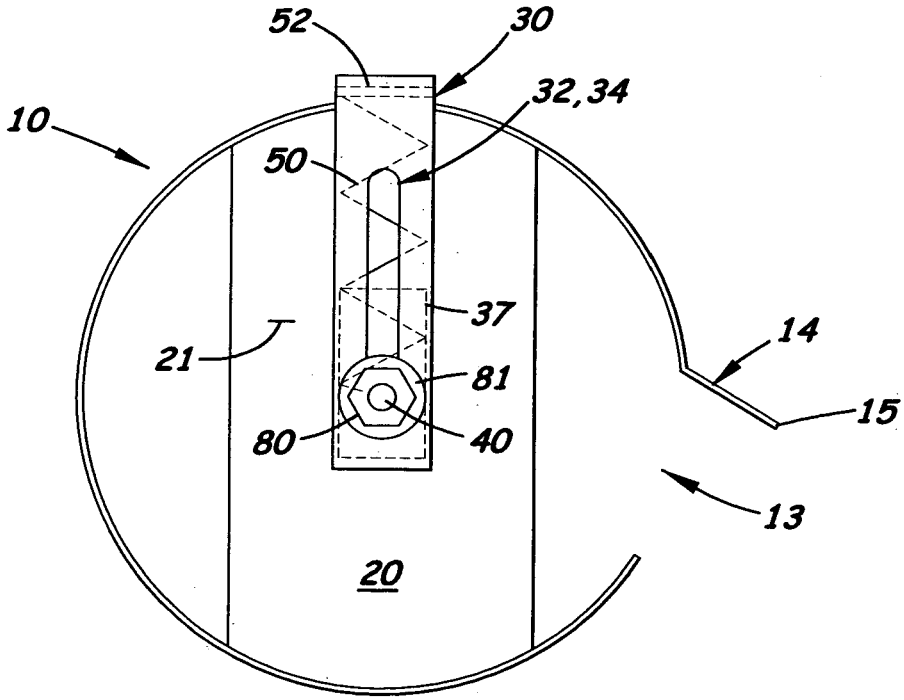
FIG. 3 is a rear side elevational view of the dispenser shown in FIG. 2.
Figure 4:
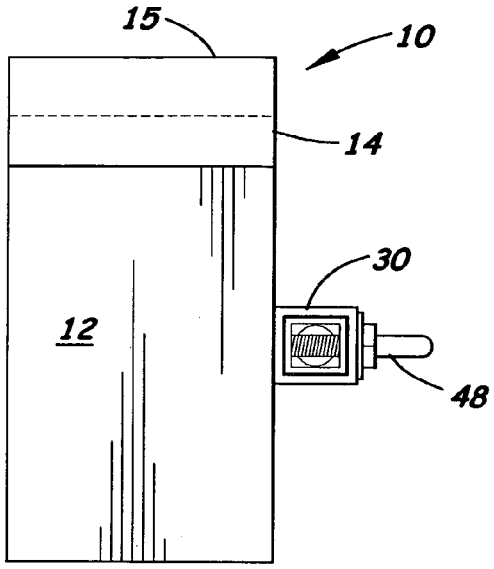
FIG. 4 is a top plan view of the dispenser shown in FIGS. 2 and 3.
Figure 5:
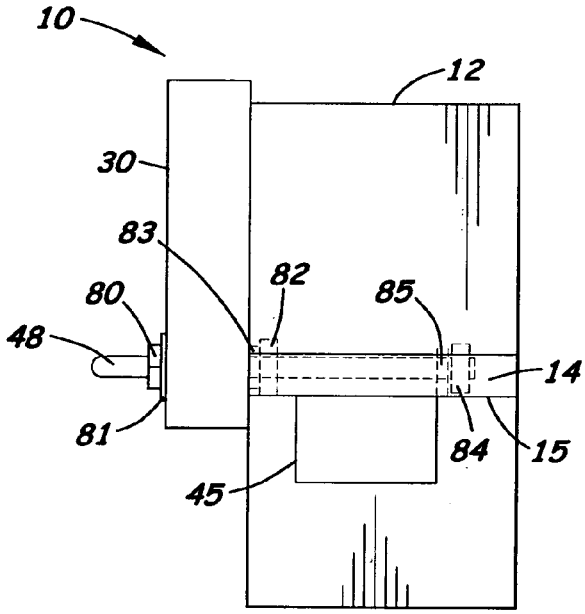
FIG. 5 is a left side elevational view of the dispenser shown in FIGS. 2–4.
Figure 6:
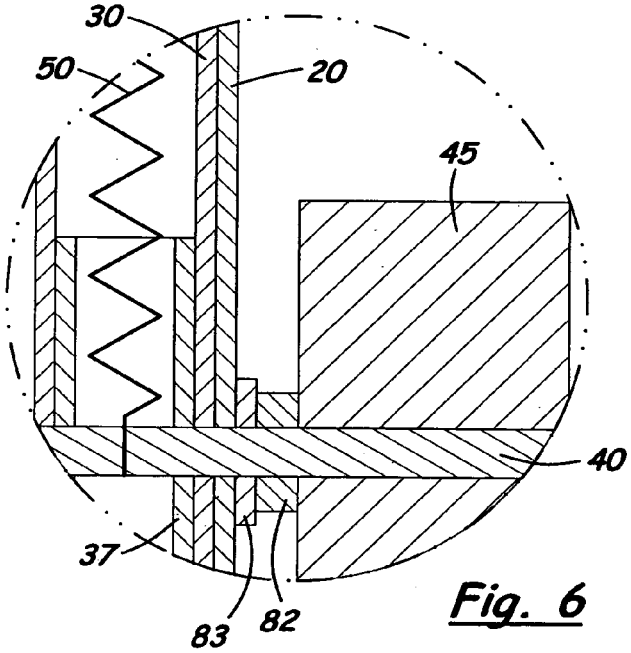
FIG. 6 is a sectional, side elevational view of the axle and pipe.

Referring to the FIGS., there is shown a paper back tape dispenser, 10 that includes a cylindrical outer shell 12 made of sheet metal attached to an optional, transversely aligned back plate 20. Formed on one side of the outer shell 12 is a side opening 13 with a forward extending lip 14 with a distal serrated cutting edge 15 formed thereon. The back plate 20 is securely attached to the back edge of the outer shell 12 thereby forming a cylindrical cavity 16 inside the outer shell 12 capable of receiving a roll of tape 90.

Longitudinally aligned and attached to the rear surface 21 of the back plate 20 is a hollow short pipe 30. Formed on the inside and outside surfaces of the short pipe 30 are two longitudinally aligned slots 32, 34. Located inside the short pipe 30 is a cylindrical shaped sliding piston 37. The sliding piston 37 is hollow and opened at its opposite ends and slightly smaller in diameter than the pipe 30. During operation, the piston 37 slides freely inside the pipe 30 and acts as a stabilizer for the axle 40.

Perpendicularly aligned and extending through the piston 37 is a threaded axle 40 designed to hold a spool 45 that is inserted into the center void area 92 on a roll of tape 90. During assembly, the piston 37 is longitudinally aligned and inserted into the top opening in the pipe 30. The two longitudinally aligned slots 32, 34 formed on the pipe 30 extend upward and terminate on the top opening. The length of the slots 32, 34 are sufficient so that the axle 40 may be selectively moved between a centrally aligned position on the outer shell 12 to an offset position toward the upper surface outer shell 12. The axle 40 is sufficient in length to partially extend into the cavity 16 and rearward from the pipe 30. The portion of the axle 40 that extends into the cavity 16 is sufficient in length so that a spool 45 may be securely attached thereto and inserted into the center void area 92 of a roll of tape 90. An outer nut 80 and washer 81 are placed on the outer section of the axle 40 that extends from the pipe 30. An inner nut 82 and washer 83 are placed on the axle 30 on the inside surface of the back plate 20 to prevent the axle 40 from moving inward and outward on the outer shell 12. A third set of nut 84 and washer 85 is placed on the axle 40 against the outside surface of the spool 45 and used to prevent the spool 45 from disengaging from the axle 40.

As mentioned above, the opposite end of the axle 40 extends outward through the outside surface of the pipe 30 and through the outer slot 32. During use, the portion of the axle 40 that extends outward acts as a finger bar, designated as 48, that is used to lift the axle upward so that a new large roll of tape 90 may be placed over the axle 40 and into the cylindrical cavity 16.

A spring 50 is disposed inside the pipe 30 and biased between the top surface of the pipe 30 and the axle 40. A pin 52 is transversely align on the top end of the pipe 30 upon which the top edge of the spring 50 is engaged. The lower end of the spring 50 is inserted or wrapped around the axle 40. During operation, the spring 50 constantly resists stretching and acts to force the axle 40 upward in the pipe 30 so that the upper surface of a roll of tape 90 is pressed against the upper, inside surface of the outer shell 12.

A standard, full roll of tape 90 measures approximately 5⅞ inches in diameter and 3 inches in width. The diameter of the inside center void area 92 on the roll of tape 90 is approximately 3 inches in diameter. In the preferred embodiment, the outer shell 12 is made of sheet metal and measures approximately 6 inches in diameter and 4 inches in width. The side opening 13 measures approximately 2¼ inches in height and 4 inches in width. The spool 45 which is made of metal, wood, or plastic measures measure approximately 2¾ inches in diameter and 1¾ inches in width. The center hole (not shown) in the spool 45 is approximately ¼ inches in diameter. The pipe 30 is made of square metal stock material approximately 4 inches in length and 1 inch in width. The two slots 32, 34 each measure approximately ⅜ inches in width and approximately 3 inches in length. The piston 37 is also made of square metal stock material and measures approximately 2½ inches in length and ¾ inches in width. The axle 40 is approximately 6 inches in length and ¼ inches in diameter.

During use, the user selects a roll of tape 90 and grabs the exposed end 93 of the tape and separates the paper layer 94 from the tape 90 as shown in FIG. 1. The paper layer 94 is wrapped around the roll of tape 90 counter clockwise to expose the adhesive layer around the entire roll of tape 90. The finger bar 48 is then lifted so that a roll of tape 90 may be placed onto the spool 45 and into the cavity 16. The finger bar 48 is then released thereby allowing the roll of tape 90 to be pressed against the top inside surface of the outer shell 12.

The dispenser 10 is normally held vertically with one hand while the end 93 of the tape 90 is extended through the side opening 13. The user places his or her thumb on the lip structure 14 and then wraps the tips of the other four fingers around the outer edge of the roll of tape 90 and holds the roll of tape 90 against the upper inside surface of the outer shell 12. To dispense tape, the end 93 of the tape is pulled outward and the paper layer 94 is automatically removed. The end 93 of the tape is then pulled upward to cut the tape over the serrated edge 16.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A paper-back tape dispenser, comprising:

a. a cylindrical outer shell with a centrally aligned cavity, a side opening and an upper lip structure, said lip structure includes a distal cutting edge;

b. a hollow pipe transversely aligned and attached to said outer shell, said pipe includes two longitudinal slots formed therein and an upper stop surface;

c. a piston located inside said pipe and capable sliding freely therein;

d. an axle perpendicularly aligned on said piston, said axle being aligned on said piston so that when said piston is longitudinally aligned and disposed inside said pipe, said axle partially extends inward and into said cavity and partially extends outward from said pipe;

e. a rotating spool attached to the portion of said axle that extends into said cavity, said spool capable of receiving a roll of adhesive tape;

f. means for attaching said spool to said axle to hold said spool inside said outer shell; and, g. a biasing means disposed between said axle and said pipe thereby automatically forcing a roll of tape upward and against the inside surface of said outer shell to prevent said roll of tape from unraveling.

2. The tape dispenser, as recited in claim 1, wherein said outer shell in made of sheet metal.

3. The tape dispenser, as recited in claim 1, further including a roll of paper-back adhesive tape attached to said spool.

* * * * *